US007943840B2

(12) United States Patent
Yoshino et al.

(10) Patent No.: US 7,943,840 B2
(45) Date of Patent: May 17, 2011

(54) PERCUSSION INSTRUMENT BRACKET SYSTEMS AND METHODS

(75) Inventors: Kiyoshi Yoshino, Hamamatsu (JP); Hidekazu Higuchi, Hamamatsu (JP)

(73) Assignee: Roland Corporation, Hamamatsu, Shizuoka-ken (JP)

( * ) Notice: Subject to any disclaimer, the term of this patent is extended or adjusted under 35 U.S.C. 154(b) by 0 days.

(21) Appl. No.: 12/699,710

(22) Filed: Feb. 3, 2010

(65) Prior Publication Data

US 2010/0313734 A1 Dec. 16, 2010

(30) Foreign Application Priority Data

Jun. 11, 2009 (JP) ..... 2009-139731

(51) Int. Cl.
*G10D 13/02* (2006.01)

(52) U.S. Cl. ..... 84/421

(58) Field of Classification Search ..... 84/421
See application file for complete search history.

(56) References Cited

U.S. PATENT DOCUMENTS

| | | | | | |
|---|---|---|---|---|---|
| 2,919,618 | A | * | 1/1960 | Slingerland, Jr. | 84/421 |
| 3,561,716 | A | * | 2/1971 | Thompson et al. | 248/286.1 |
| 3,576,149 | A | * | 4/1971 | Slingerland, Jr. | 84/421 |
| 4,158,980 | A | * | 6/1979 | Gauger | 84/421 |
| 4,596,176 | A | * | 6/1986 | Gauger | 84/421 |
| 4,800,795 | A | * | 1/1989 | Yamashita | 84/421 |
| 5,105,710 | A | * | 4/1992 | Rothmel | 84/730 |
| 5,329,838 | A | * | 7/1994 | Yamashita | 84/421 |
| 5,337,645 | A | * | 8/1994 | Johnston | 84/421 |
| D350,762 | S | * | 9/1994 | Ohno | D17/22 |
| 5,454,288 | A | * | 10/1995 | Hoshino | 84/421 |
| 5,477,767 | A | * | 12/1995 | May | 84/421 |
| 5,507,584 | A | * | 4/1996 | Sassmannshausen et al. | 403/78 |
| 5,544,561 | A | * | 8/1996 | Isomi | 84/421 |
| 5,600,080 | A | * | 2/1997 | Belli | 84/421 |
| 5,645,253 | A | * | 7/1997 | Hoshino | 248/181.1 |
| 5,660,364 | A | * | 8/1997 | Hsieh | 248/309.1 |

(Continued)

FOREIGN PATENT DOCUMENTS

JP H05-073693 U 10/1993

(Continued)

OTHER PUBLICATIONS

Translation for Japanese patent application JP H05-073693 U published Oct. 8, 1993.

(Continued)

*Primary Examiner* — Jeffrey Donels
*Assistant Examiner* — Robert W Horn
(74) *Attorney, Agent, or Firm* — Foley & Lardner LLP

(57) ABSTRACT

A support bracket having a body may be configured to be mountable on a percussion instrument, the body having a first passage defined at least in part by a first wall surface, the body having a second passage defined at least in part by a second wall surface. A fastening member may be configured to clamp a first support rod to the body in a case where the first support rod is inserted into the first passage and the fastening member operatively engages the first support rod to press the first support rod against the first wall surface, and to clamp a second support rod to the body in a case where the second support rod is inserted into the second passage and the fastening member operatively engages the second support rod to press the second support rod against the second wall surface.

18 Claims, 7 Drawing Sheets

U.S. PATENT DOCUMENTS

| | | | | |
|---|---|---|---|---|
| 6,075,190 | A * | 6/2000 | Mosser et al. | 84/421 |
| 6,828,494 | B2 * | 12/2004 | Toda | 84/411 R |
| D568,378 | S * | 5/2008 | Nakao et al. | D17/22 |
| 7,381,876 | B2 * | 6/2008 | Miyajima | 84/421 |
| 7,612,273 | B2 * | 11/2009 | Matsuyuki et al. | 84/411 R |
| 7,741,551 | B2 * | 6/2010 | Mori | 84/421 |
| 2007/0234886 | A1 * | 10/2007 | Matsuyuki et al. | 84/723 |
| 2008/0163739 | A1 * | 7/2008 | Mori | 84/421 |
| 2009/0250584 | A1 * | 10/2009 | Hsieh | 248/346.06 |
| 2010/0313734 | A1 * | 12/2010 | Yoshino et al. | 84/421 |
| 2011/0030531 | A1 * | 2/2011 | Nakata et al. | 84/421 |

FOREIGN PATENT DOCUMENTS

| | | |
|---|---|---|
| JP | H10-198347 A | 7/1998 |

OTHER PUBLICATIONS

Translation for Japanese patent application JP H10-198347 A published Jul. 31, 1998.

* cited by examiner

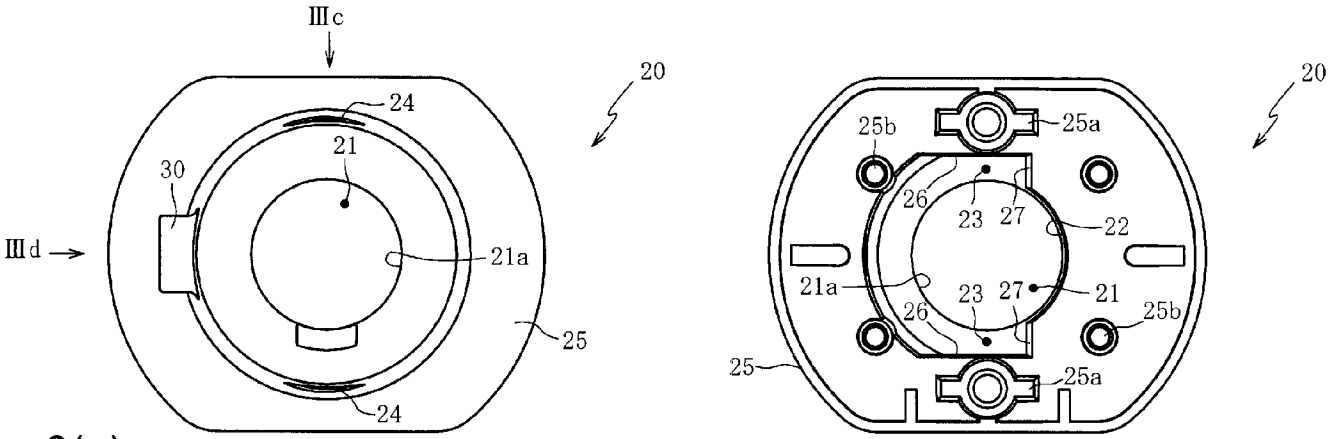
Fig. 3(a)
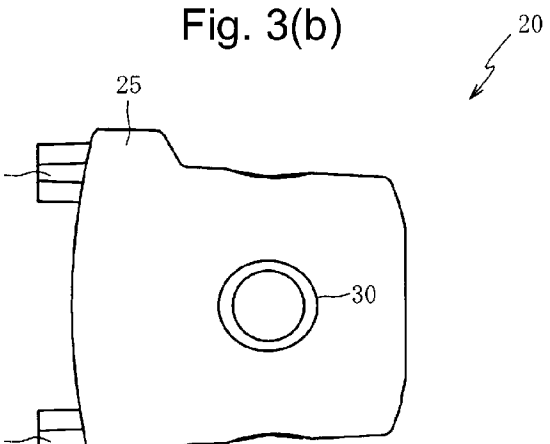
Fig. 3(b)
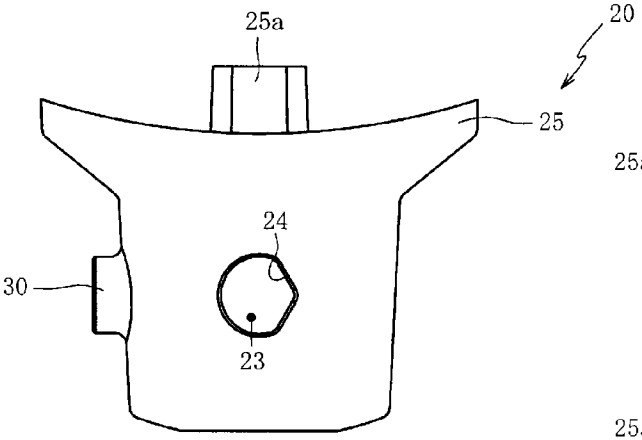
Fig. 3(c)
Fig. 3(d)

PERCUSSION INSTRUMENT BRACKET SYSTEMS AND METHODS

CROSS-REFERENCE TO RELATED PATENT APPLICATIONS

Japan Priority Application 2009-139731, filed Jun. 11, 2009 including the specification, drawings, claims and abstract, is incorporated herein by reference in its entirety.

BACKGROUND

1. Field of the Invention

Embodiments of the present invention generally relate to a bracket for a percussion instrument, and, in specific embodiments, to a bracket for a percussion instrument for supporting rods of varying thicknesses.

2. Related Art

A drum bracket is mounted on a percussion instrument, such as a drum, in order to support the drum on drum fixing hardware. The drum fixing hardware includes a support rod that is clamped and fixed to the drum bracket. Accordingly, a user-performer can customize a position of the drum.

There are generally two types of support rods: large diameter support rods (22.2 mm diameter) and small diameter support rods (9-11.5 mm diameter). Thus, in a case where a drum bracket mounted on a drum is adapted to receive a large diameter support rod, if a small diameter support rod is used, the drum bracket will have to be replaced with a drum bracket adapted to receive the small diameter support rod.

Japanese Laid-Open Patent Application Publication (Kokai) Number H10-198347 discloses a drum bracket configured to receive the large diameter support rod and the small diameter support rod. This bracket includes first hardware, which includes a first engaging groove and a second engaging groove, combined with second hardware, which includes a third engaging groove and a fourth engaging groove, to allow various support rods of varying thickness to be attached to the drum.

However, in a case where a support rod of one thickness is changed to a support rod of an other thickness, the bolt and butterfly bolt that attaches the second hardware to the first hardware must be removed, and then re-fastened once the support rod is changed. With such brackets, exchanging support rods are unnecessarily complicated and time-consuming.

SUMMARY OF THE DISCLOSURE

A bracket for mounting on a drum may include, but is not limited to, a main body section and a bolt member. The main body section may be for mounting on the drum. The main body section may have a screwing channel formed through a wall surface of the main body section. An inner peripheral surface may define the screwing channel. The inner peripheral surface may have female threads. The bolt member may be for screwing into the screwing channel of the main body section. The bolt member may have male threads.

The main body section may be configured to clamp to one of a large diameter support rod for attaching to a drum fixing device and a small diameter support rod for attaching to a drum fixing device by screwing the bolt member into the screwing channel. The small diameter support rod may have a diameter less than a diameter of the large diameter support rod.

The main body section may have at least one first passage into which one of the large diameter support rod and the small diameter support rod is inserted. The first passage may be defined at least in part by a first wall surface. The first wall surface may face a direction in which the bolt member is screwed into the screwing channel.

The main body section may have a second passage into which the other of the large diameter support rod and the small diameter support rod, relative to the one of the large diameter support rod and the small diameter support rod, is inserted. The second passage may intersect the first passage. The second passage may be defined at least in part by a same direction of the first wall surface. The one of the large diameter support rod and the small diameter support rod inserted into the first passage may be clamped and fixed to the main body section by being pressed against the first wall surface by the bolt member. The other of the large diameter support rod and the small diameter support rod, relative to the one of the large diameter support rod and the small diameter support rod, inserted into the second passage may be clamped and fixed to the main body section by being pressed against the second wall surface by the bolt member.

In such embodiments, the one of the large diameter support rod and the small diameter support rod may be clamped to the main body section by merely adjusting an amount the bolt member is screwed into the main body section. In such embodiments, the other of the large diameter support rod and the small diameter support rod, relative to the one of the large diameter support rod and the small diameter support rod, may be clamped to the main body section by merely adjusting an amount the bolt member is screwed into the main body section.

Therefore, either of the large diameter support rod and the small diameter support rod may be clamped to the drum bracket by merely adjusting an amount the bolt member is screwed into the main body section. Thus, when a support rod (e.g., the large diameter support rod) is replaced with an other support rod having a different thickness (e.g., the small diameter support rod), the support rods may be changed easily and quickly.

In various embodiments, the bracket may further include a first clamping member. The first clamping member may be inserted between the first wall surface and the screwing channel. The first clamping member may have a main surface having an area broader than an area of a tip surface of the bolt member. The one of the large diameter support rod and the small diameter support rod inserted in the first passage may be fixed and clamped to the main body section by being pressed against the first wall surface by the main surface of the first clamping member. The other of the large diameter support rod and the small diameter support rod, relative to the one of the large diameter support rod and the small diameter support rod, inserted into the second passage may be clamped and fixed to the main body section by being pressed against the second wall surface by the main surface of the first clamping member.

In such embodiments, the one of the large diameter support rod and the small diameter support rod may be pressed against the first wall surface by a larger area than that provided by an end of the bolt member. Accordingly, the one of the large diameter support rod and the small diameter support rod may be clamped securely. In such embodiments, the other of the large diameter support rod and the small diameter support rod, relative to the one of the large diameter support rod and the small diameter support rod, may be pressed against the first wall surface by a larger area than that provided by an end of the bolt member. Accordingly, the other of the large diameter support rod and the small diameter support rod, relative to the one of the large diameter support rod and the small diameter support rod, may be clamped securely.

In some embodiments, the main body section may have a pair of sliding surfaces facing each other and spaced apart a distance. The pair of sliding surfaces may be parallel to the direction in which the bolt member is screwed. The first clamping member may have a contact section in contact with the pair of sliding surfaces. The contact section may be configured to be guided by the pair of sliding surfaces in the direction in which the bolt member is screwed.

In such embodiments, movement of the first clamping member may be limited in any direction other than the direction in which the bolt is screwed. Accordingly, the drum may be securely supported by one of the large diameter support rod and the small diameter support rod may be clamped securely.

In further embodiments, the bracket may further include a second clamping member. The second clamping member may be cylindrical and may be made of a synthetic resin arranged in the main body section. The one of the large diameter support rod and the small diameter support rod may be fit into the second clamping member. The one of the large diameter support rod and the small diameter support rod fit into the second clamping member may be clamped and fixed to the main body section by being pressed against a portion of the second clamping member elastically deformed by the bolt member.

In such embodiments, the large diameter support rod or the small diameter support rod may be contacted with a broader area to more securely clamp the large diameter support rod or the small diameter support rod. In such embodiments, the second clamping member made of synthetic resin may prevent the large diameter support rod or the small diameter support rod from slipping and/or falling out of the main body section.

A support bracket for mounting on a percussion instrument may include, but is not limited to, a body and a fastening member. The body may be configured to be mountable on the percussion instrument. The body may have a channel extending through a wall of the body. The body may have a first passage defined at least in part by a first wall surface of the body. The first passage may be for receiving a first support rod. The body may have a second passage defined at least in part by a second wall surface of the body. The second passage may be for receiving a second support rod.

The fastening member may be insertable into the channel of the body to operatively engage one of the first support rod and the second support rod. The fastening member may be configured to clamp the first support rod to the body in a case where the first support rod is inserted into the first passage and the fastening member operatively engages the first support rod to press the first support rod against the first wall surface. The fastening member may be configured to clamp the second support rod to the body in a case where the second support rod is inserted into the second passage and the fastening member operatively engages the second support rod to press the second support rod against the second wall surface.

In various embodiments, the second support rod may have a diameter less than a diameter of the first support rod. In various embodiments, a surface defining the channel may include a threaded portion. The fastening member may have a threaded portion for engaging the threaded portion of the surface. In various embodiments, at least one of the first support rod and the second support rod may be operatively connected to a stand for supporting the percussion instrument.

In various embodiments, the first wall surface of the body may face a direction parallel to a direction in which the fastening member is inserted into the channel of the body. In various embodiments, the second wall surface of the body may face a direction parallel to a direction in which the fastening member is inserted into the channel of the body. In various embodiments, the first passage of the body may intersect the second passage of the body. In various embodiments, the percussion instrument may be a drum.

In various embodiments, the support bracket may further include a first clamping member. The first clamping member may be arranged in the body between the first wall surface of the body and the wall having the channel of the body. The first clamping member may be configured to clamp the first support rod to the body in a case where the first support rod is inserted into the first passage and the fastening member causes the first clamping member to press the first support rod against the first wall surface. The first clamping member may be configured to clamp the second support rod to the body in a case where the second support rod is inserted into the second passage and the fastening member causes the first clamping member to press the second support rod against the second wall surface.

In some embodiments, the first clamping member may have an outer peripheral surface and an inner peripheral surface. The inner peripheral surface may be for contacting the one of the first support rod and the second support rod. The outer peripheral surface may be arranged to be pressed upon by the fastening member so that the inner peripheral surface contacts the one of the first support rod and the second support rod.

In further embodiments, the inner peripheral surface of the first clamping member may have an area greater than an area of a portion of the fastening member pressing upon the outer peripheral surface.

In various embodiments, the support bracket may further include a clamp member. The clamp member may be arranged in the body. The clamp member may be configured to clamp the first support rod to the body in a case where the first support rod is inserted into the first passage and the fastening member causes the clamp member to press the first support rod against the first wall surface. The clamp member may be configured to clamp the second support rod to the body in a case where the second support rod is inserted into the second passage and the fastening member causes the clamp member to press the second support rod against the second wall surface.

In some embodiments, the clamp member may have a moveable portion. The clamp member may be configured to clamp the first support rod to the body in a case where the first support rod is inserted into the first passage and the fastening member causes the moveable portion of the clamp member to press the first support rod against the first wall surface. The clamp member may be configured to clamp the second support rod to the body in a case where the second support rod is inserted into the second passage and the fastening member causes the moveable portion of the clamp member to press the second support rod against the second wall surface.

BRIEF DESCRIPTION OF THE DRAWINGS

FIG. 1(*b*) is a perspective view of a percussion instrument in a case where a second support rod has been fixed to the percussion instrument upon which a support bracket is mounted according to an embodiment of the present invention;

FIG. 3(*a*) is a view of a portion of a support bracket according to an embodiment of the present invention;

FIG. 3(*b*) is another view of a portion of a support bracket according to an embodiment of the present invention;

FIG. 3(*c*) is another view of a portion of a support bracket viewed from a direction of arrow IIIc in FIG. 3(*a*) according to an embodiment of the present invention;

FIG. 3(*d*) is another view of a portion of a support bracket viewed from a direction of arrow IIId in FIG. 3(*a*) according to an embodiment of the present invention;

FIG. 4(*b*) is another view of a portion of a support bracket viewed from a direction of arrow IVb in FIG. 4(*a*) according to an embodiment of the present invention;

FIG. 4(*c*) is another view of a portion of a support bracket viewed from a direction of arrow IVc in FIG. 4(*a*) according to an embodiment of the present invention;

FIG. 5(*b*) is another view of a portion of a support bracket according to an embodiment of the present invention;

FIG. 5(*c*) is another view of a portion of a support bracket viewed from a direction of arrow Vc in FIG. 5(*a*) according to an embodiment of the present invention;

FIG. 5(*d*) is another view of a portion of a support bracket viewed from a direction of arrow Vd in FIG. 5(*a*) according to an embodiment of the present invention;

FIG. 6(*b*) is a cross-section view of a support bracket along line VIb-VIb of FIG. 6(*a*) according to an embodiment of the present invention;

FIG. 7(*b*) is a cross-section view of a support bracket along line VIIb-VIIb of FIG. 7(*a*) according to an embodiment of the present invention.

DETAILED DESCRIPTION

Figure 1A:
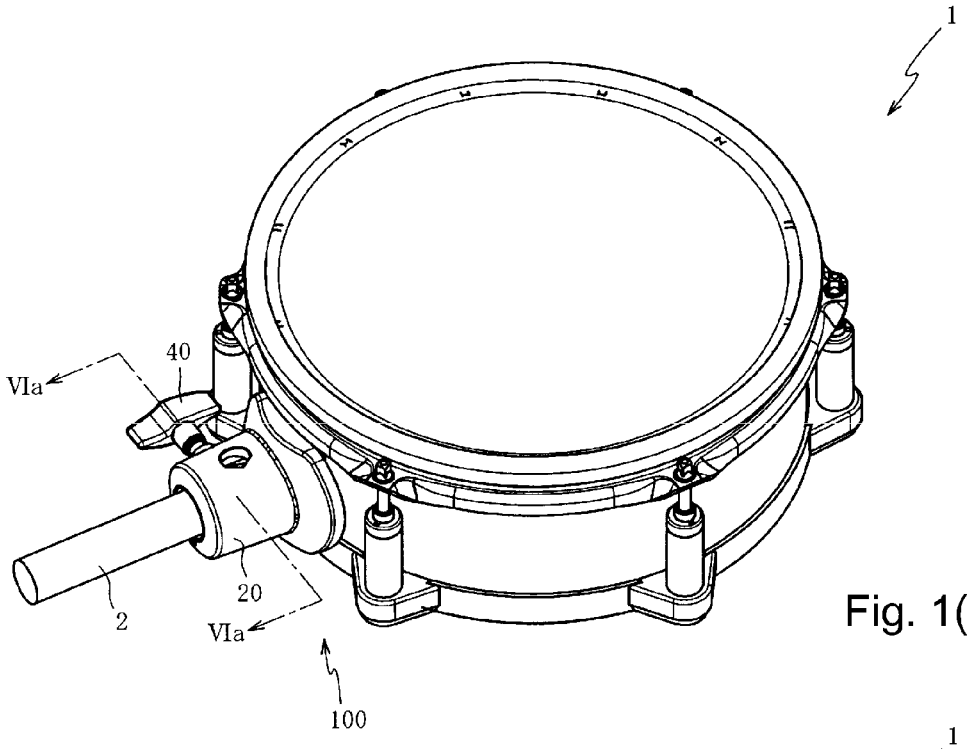
FIG. 1(*a*) is a perspective view of a percussion instrument in a case where a first support rod has been fixed to the percussion instrument upon which a support bracket is mounted according to an embodiment of the present invention.
Figure 1B:
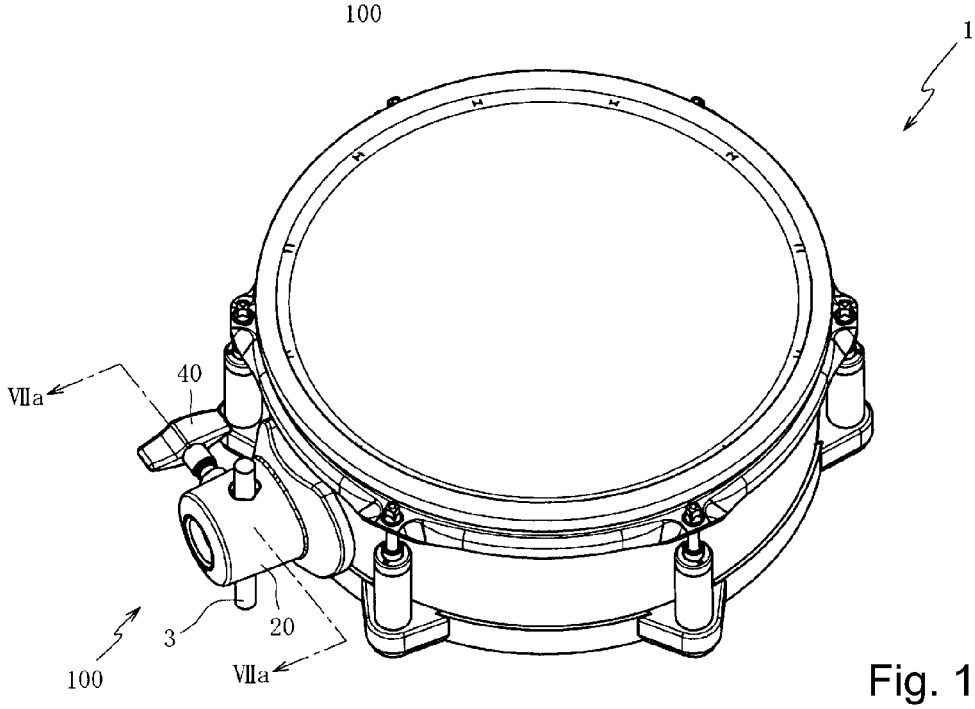
Figure 2:
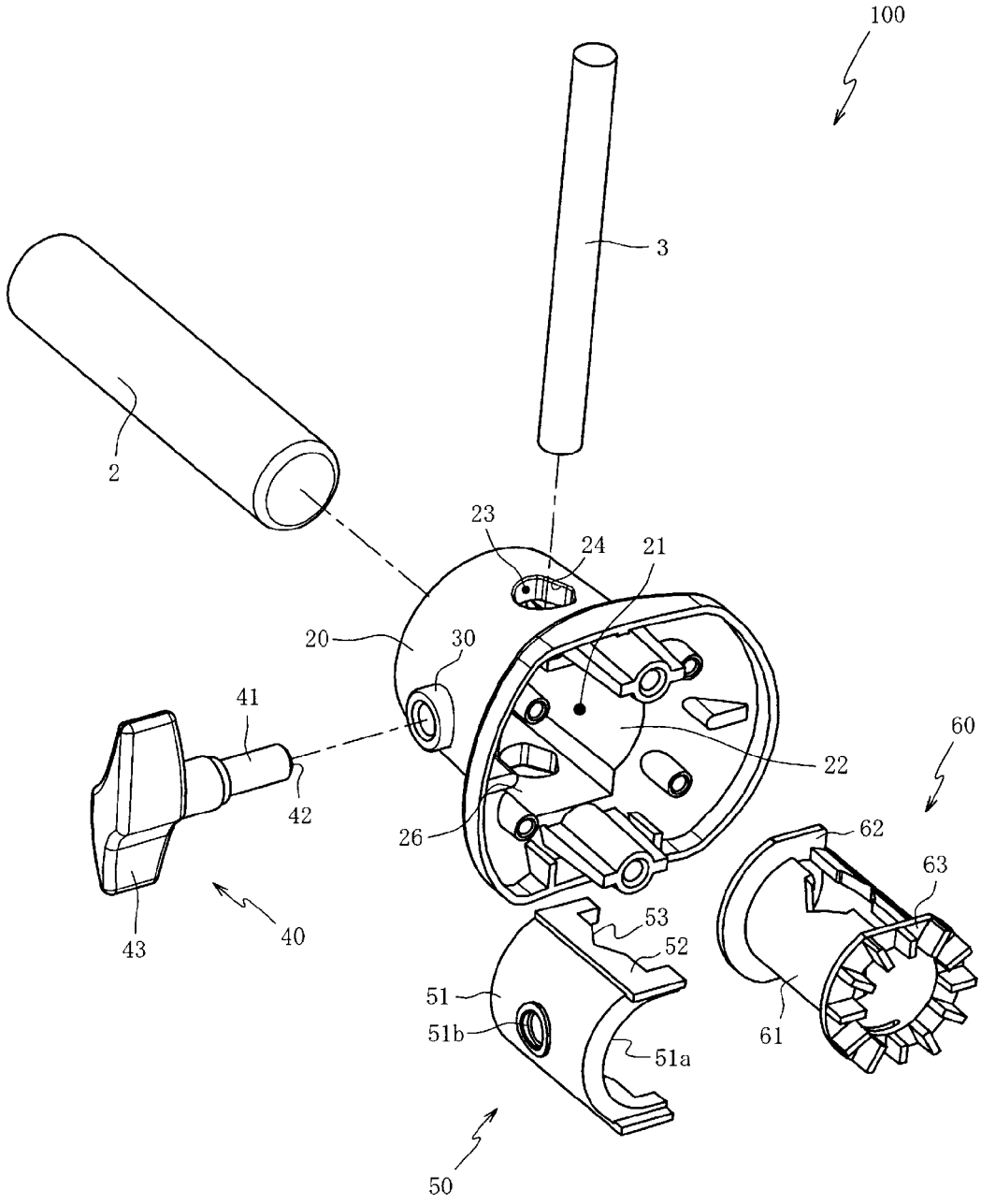
FIG. 2 is an exploded perspective view of a support bracket for a percussion instrument according to an embodiment of the present invention.

FIG. 1(*a*) is a perspective view of a percussion instrument, such as drum 1, in a case where a first support rod 2 has been fixed to the drum 1 upon which a support bracket 100 is mounted according to an embodiment of the present invention. FIG. 1(*b*) is a perspective view of a percussion instrument, such as the drum 1, in a case where a second support rod 3 has been fixed to the drum 1 upon which the support bracket 100 is mounted according to an embodiment of the present invention. FIG. 2 is an exploded perspective view of the support bracket 100 according to an embodiment of the present invention.

With reference to FIGS. 1(*a*)-2, the support bracket 100 may be configured to receive or otherwise connect to a support rod, such as the first support rod 2 and the second support rod 3, that is operatively connected with a drum fixing device (not shown). The support bracket 100 may be configured to mount to the drum 1 such that the drum fixing device is operatively connected to the drum 1.

As shown in FIG. 1(*a*), in a case where the drum 1 is mounted with the first support rod 2, which is attached to the drum fixing device, the first support rod 2 may be inserted into the support bracket 100 in a direction substantially perpendicular (i.e., substantially at a right angle) to an axial direction of the drum 1. The first support rod 2 may be clamped and fixed to the support bracket 100.

As shown in FIG. 1(*b*), in a case where the drum 1 is mounted with the second support rod 3, which is attached to the drum fixing device, the second support rod 3 may be inserted into the support bracket 100 in a direction substantially parallel with the axial direction of the drum 1. The second support rod 3 may be clamped and fixed to the support bracket 100.

With reference to FIGS. 1(*a*)-2, the support bracket 100 may include a main body 20, a fastening member 40, a first clamping member 50, and a second clamping member 60. The main body 20 may be for mounting on the drum 1. The main body 20 may have a channel 30 passing through an outer wall surface of the main body 20. In some embodiments, a surface defining the channel 30 may extend beyond the main body 20 to protrude from the outer wall surface of the main body 20.

A fastening member 40, such as a bolt, screw, or the like, may be insertable into the channel 30 of the main body 20. In some embodiments, the surface defining the channel 30 may include threads (e.g., female thread) for mating with threads (e.g., male threads) of the fastening member 40. In such embodiments, for example, the threaded surface (for mating with the fastening member 40) may be relatively large to provide a greater pressing force when the fastening member 40 is fastened (e.g., screwed) into the main body 20.

The first clamping member 50 may be configured to receive at least a portion of the second clamping member 60 such that the second clamping member 60 is at least partially fit within the first clamping member 50. The main body 20 may be configured to receive at least a portion of the first clamping member 50 into which (at least a portion of) the second clamping member 60 is inserted.

The fastening member 40 may be knob or the like that may include an engagement portion 41 and a grip member 43. The engagement portion 41 may include an end surface 42 on an end of the engagement portion 41 opposite an end supporting the grip member 43. The engagement portion 41 of the fastening member 40 may be insertable into the channel 30 of the main body 20. The fastening member 40 may be fastened (e.g., screwed) in the channel 30 of the main body by turning or otherwise manipulating the grip member 43 of the fastening member 40.

The first clamping member 50 may include a pressing portion 51 and an engagement portion 52. The pressing portion 51 (or a portion thereof) may be shaped to be fit into the main body 20. For example, the pressing portion 51 may have a curved shape to match a curved contour within the main body 20. In particular embodiments, the first clamping member 50 may be formed to have a cross-section of the letter "U" when viewed from the side.

The engagement portion 52 may comprise a pair of engagement portions 52 with each of the pair of engagement portions 52 arranged adjacent (e.g., in contact with) with a respective end of the pressing portion 51. The engagement portions 52 of the pair of engagement portions 52 may be substantially parallel to each other.

In some embodiments, one or both of the engagement portions 52 of the pair of engagement portions 52 may have a flat planar shape. In other embodiments, one or both of the engagement portions 52 of the pair of engagement portions 52 may have any other suitable shape.

In some embodiments, the first clamping member 50 may be made of a metal or the like. In other embodiments, the first clamping member 50 may be made of any suitable rigid material including, but not limited to, plastic, a synthetic resin, rubber, glass, wood, ceramic, composite materials, and/or the like.

The second clamping member 60 may be a cylindrically shaped body. The second clamping member 60 may include a cylindrically-shaped tubular body 61, a first limiting member 62, and a second limiting member 63.

The first limiting member 62 may be disposed on a first end of the tubular body 61. The second limiting member 63 may be disposed on a second end, opposite the first end, of the tubular body 61 to be substantially parallel with the first limiting member 62. The first limiting member 62 and the second limiting member 63 (or portions thereof) may have similar shapes. For example, each of the first limiting member 62 and the second limiting member 63 may be "U"-shaped, or otherwise be arc-shaped, when viewed from a side (e.g., FIG. 5(*b*)).

In some embodiments, the second clamping member 60 may be made of a synthetic resin or the like. In other embodiments, the second clamping member 60 may be made of any suitable rigid material including, but not limited to, plastic, metal, rubber, glass, wood, ceramic, composite materials, and/or the like.

In various embodiments, the first clamping member 50 may be configured to fit to the second clamping member 60, for instance, by receiving at least a portion of the second clamping member 60 such that the second clamping member 60 is at least partially fit within the first clamping member 50. In specific embodiments, the pressing portion 51 of the first clamping member 50 may be fit between the first limiting member 62 and the second limiting member 63. Together the first clamping member 50 and the second clamping member 60 may be provided within the main body 20. Movement of the first clamping member 50 and the second clamping member 60 within the main body 20 may be limited because of the two components being fit together. In some embodiments, the first clamping member 50 and the second clamping member 60 may be inserted into the main body 20 together. In other embodiments, the first clamping member 50 and the second clamping member 60 may be inserted into the main body 20 individually.

FIGS. 3(*a*)-3(*d*) illustrate various views of a portion of a support bracket, such as the main body 20 of the support bracket 100, according to an embodiment of the present invention. FIG. 3(*a*) is a front surface view of a portion of a support bracket, such as the body 20 of the support bracket 100, according to an embodiment of the present invention. FIG. 3(*b*) is a rear surface view of a portion of a support bracket, such as the main body 20 of the support bracket 100, according to an embodiment of the present invention. FIG. 3(*c*) is a top surface view of a portion of a support bracket, such as the main body 20 of the support bracket 100, viewed from a direction of arrow Mc in FIG. 3(*a*) according to an embodiment of the present invention. FIG. 3(*d*) is a lateral surface view of a portion of a support bracket, such as the main body 20 of the support bracket 100, viewed from a direction of arrow IIId in FIG. 3(*a*) according to an embodiment of the present invention.

The main body 20 may include a first wall surface 22, a second wall surface 24, and a mounting portion 25. The main body 20 may have a first passage 21 and a second passage 23. The main body 20 may have an opening 21 a that opens to the first passage 21. The first passage 21 may extend from the opening 21*a* (e.g., near side in FIG. 3(*a*)) of the main body 20 to a rear surface (e.g., near side in FIG. 3(*b*)) of the main body 20. The first passage 21 may be a passage into which the first support rod 2 (e.g., FIG. 2) may be inserted. Thus in some embodiments, the first passage 21 may extend through the main body 20 in a direction substantially perpendicular (i.e., substantially at a right angle) to the axial direction of the drum 1.

The first wall surface 22 may be a portion (e.g., arc-shaped portion) of a wall surface defining the first passage 21. The first wall surface 22 may be facing the fastening member (e.g., FIG. 2) in a case where the fastening member 40 is inserted into the channel 30 of the main body 20.

The second passage 23 may intersect with the first passage 23. The main body 20 may have an opening (e.g., near side of FIG. 3(*c*)) that opens to the second passage 23. The opening that opens to the second passage may be on a portion of the outer surface of the main body 20 that is substantially perpendicular to the channel 30 of the main body 20. The second passage 23 may be a passage into which the second support rod 3 (e.g., FIG. 2) may be inserted. Thus in some embodiments, the second passage 23 may extend through the main body 20 in a direction substantially parallel to the axial direction of the drum 1.

The second wall surface 24 may be a portion of a wall surface defining the second passage 23. The second wall surface 24 and the first wall surface 24 may face in a common direction, such as a direction that faces the fastening member 40 as the fastening member 40 is fastened in the channel 30.

At least a portion of the wall surface defining the second passage 23 may be formed in a shape of the second support rod 3. For example, the remaining portion of the wall surface may be formed in an arc shape to allow a cylindrically-shaped second support rod 3 to be inserted into the second passage 23 easily.

In some embodiments, the second wall surface 24, for example as shown in FIG. 3(*c*), may be wedge shaped (i.e., a shape in which the second wall surface 24 tapers to a point to the screwing channel 30). In such embodiments, slippage or movement (e.g., in a radial direction) of the second support rod 3 may be prevented when the second support rod 3 is clamped and fixed.

The main body 20 may include a coupling surface 27 and a pair of sliding surface 26 within the interior of the main body 20 along the first passage 21. The pair of sliding surfaces 26 may be connected with the second wall surface 24. The pair of sliding surfaces 26 may be parallel to the direction in which the fastening member 40 is fastened to the main body 20.

The coupling surface 27, which may have a planar shape, may be connected with the first wall surface 22. The coupling surface 27 may be perpendicular to the pair of sliding surfaces 26. That is, the coupling surface 27 may be perpendicular to the direction in which the fastening member 40 is fastened to the main body 20.

The mounting portion 25 may be a rear portion (e.g., top of main body 20 in FIG. 3(*c*)), of the main body 20, for example opposite the opening 21*a*. In various embodiments, for example as shown in FIGS. 3(*c*) and 3(*d*), the mounting portion 25 may be formed in a flange shape. In other embodiments, the mounting portion 25 may be formed in any suitable shape.

The mounting portion 25 may be configured to attach to or otherwise operatively connect with the drum 1 (e.g., FIGS. 1(*a*)-1(*b*)). In some embodiments, a protruding portion 25*a* may be provided on a rear surface of the mounting portion 25 to protrude from the rear surface of the mounting portion 25.

The protruding portion 25*a* may be insertable into an opening (not shown) in the drum 1 and passed through an outer peripheral surface side of the drum to an inner peripheral surface side of the drum 1. Accordingly, for example, a fastening member, such as bolt, screw, or the like may be fastened to the protruding portion 25*a* from the inner peripheral surface side of the drum 1. In some embodiments, a portion of the protruding portion 25*a* for fastening with the fastening member may include threads for mating with threads of the fastening member. In other embodiments, the drum 1 may have a protrusion for fastening with an opening on the mounting portion 25. In other embodiments, the mounting portion 25 may be operatively connected in any suitable manner including, but not limited to, in a friction fitting, a snap fitting, adhesive, and/or the like.

In some embodiments, the rear surface of the mounting portion 25 may be configured to attach to a plate (not shown), for example, such that the plate is between the mounting portion 25 and the drum 1. For example, the mounting portion 25 may include at least one hole 25*b* or the like into which a fastening member, portion of the plate, or the like may be inserted to attach the plate to the rear surface of the mounting portion. In other embodiments, the plate may include at least one hole into which a fastening member, portion of the mounting portion 25, or the like may be inserted to attach the plate to the rear surface of the mounting portion 25. In yet other embodiments, the plate may be attached to the rear surface of the mounting portion 25 in any suitable manner.

After the first clamping member 50 and the second clamping member 60 (e.g., FIG. 2) are inserted into the main body 20, the plate may be mounted to the rear surface of the mounting portion 25 to limit movement of the first clamping member 50 and the second clamping member 60. Furthermore, the plate may prevent an end of the first support rod 2 from passing through the main body 20 and causing damage to the drum 1 (e.g., FIGS. 1(*a*)-1(*b*)). In some embodiments, the plate may be made of metal. In other embodiments, the plate may be made of any suitable rigid material including, but not limited to, plastic, a synthetic resin, rubber, glass, wood, ceramic, composite materials, and/or the like.

Figure 4A:
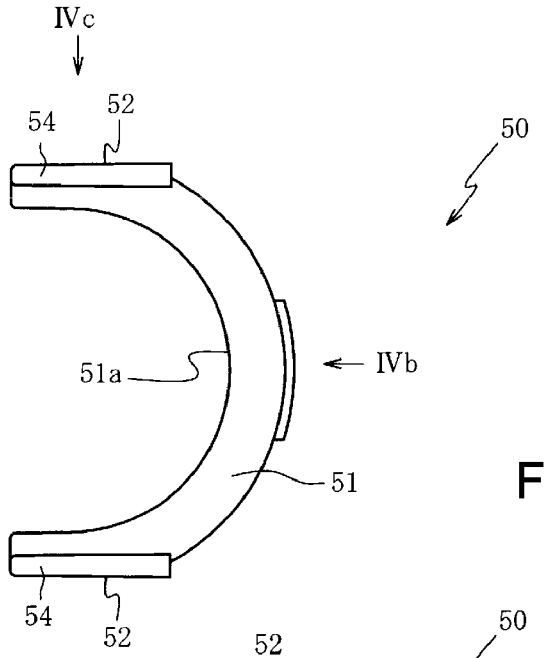
FIG. 4(*a*) is a view of a portion of a support bracket according to an embodiment of the present invention.
Figure 4B:
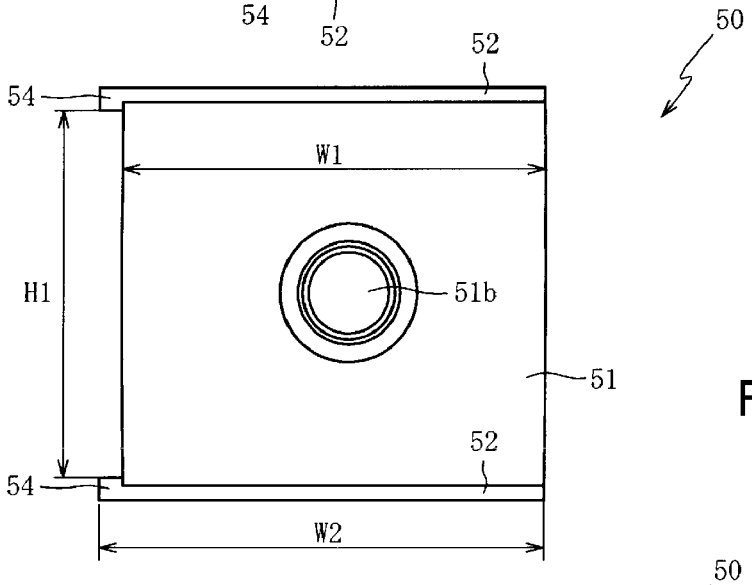
Figure 4C:
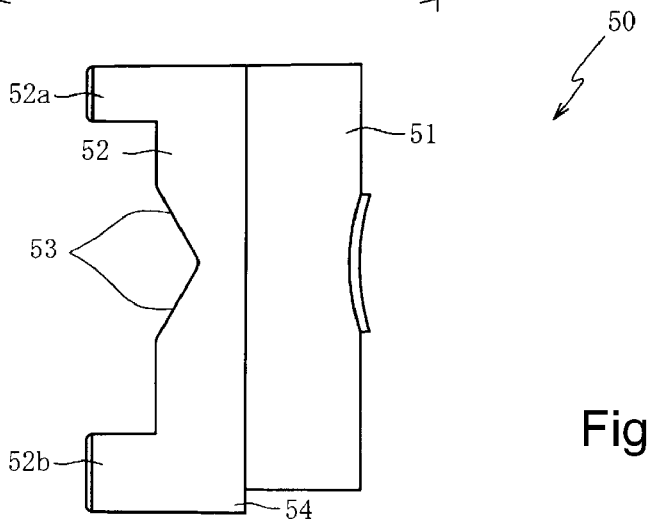

FIGS. 4(*a*)-4(*c*) illustrate various views of a portion of a support bracket, such as the first clamping member 50 of the support bracket 100, according to an embodiment of the present invention. FIG. 4(*a*) is a front surface view of a portion of a support bracket, such as the first clamping member 50 of the support bracket 100, according to an embodiment of the present invention. FIG. 4(*b*) is a lateral surface view of a portion of a support bracket, such as the first clamping member 50 of the support bracket 100, viewed from a direction of arrow IVb in FIG. 4(*a*) according to an embodiment of the present invention. FIG. 4(*c*) is a top surface view of a portion of a support bracket, such as the first clamping member 50 of the support bracket 100, viewed from a direction of arrow IVc in FIG. 4(*a*) according to an embodiment of the present invention.

The pressing portion 51 may have a first pressing surface 51*a*, which may be an inner peripheral surface of the pressing portion 51. The pressing portion 51 may include a striking portion 51*b* formed on an outer peripheral surface of the pressing portion 51. The striking portion 51*b* may be a depression formed on the outer peripheral surface of the pressing portion 51. The striking portion 51b may be pressed by the end surface 42 (e.g., FIG. 2) of the fastening member 40 as the fastening member is fastened (e.g., screwed) into the main body 20. Accordingly, a pressing force may be applied to the first clamping member 50 in a direction in which the fastening member 40 is screwed.

Each engagement portion 52 of the pair of engagement portions 52 may include a pair of protruding sections 52*a*, 52*b* and a second pressing surface 53. Each of the pair of protruding sections 52*a*, 52*b* may be located on opposite ends, in a direction of a length dimension of the first clamping member 50 (e.g., top to bottom direction in FIG. 4(*c*)), of each of the engagement portion 52 of the pair of engagement portions 52. The pair of protruding sections 52*a*, 52*b* may extend from the engagement portion 52 in a direction of a width dimension of the first clamping member 50 (e.g., right to left direction in FIG. 4(*c*)). The second pressing surface 53 may be provided between the pair of protruding sections 52*a*, 52*b*. The second passage 23 may extend along the second pressing surface 53 in a case where the first clamping member 50 is inserted into the main body 20 (refer to FIG. 7(*b*)).

At least one (e.g., 52*b*) of the pair of protruding sections 52*a*, 52*b* may include a guiding portion 54. The guiding portion 54 may extend from the at least one of the pair of protruding sections 52*a*, 52*b* in the direction of the length dimension of the first clamping member 50.

As shown in FIG. 4(*b*), a width dimension of the pressing portion 51 may be defined as width W1. A width dimension of the pressing portion 51 from one end to an end of the guiding portion 54 may be defined as width W2, and may be greater than width W1. A height dimension of the pressing portion 51 between the pair of guiding portions 54 may be defined as H1.

FIGS. 5(*a*)-5(*d*) illustrate various views of a portion of a support bracket, such as the second clamping member 60 of the support bracket 100, according to an embodiment of the present invention. FIG. 5(*a*) is a front surface view of a portion of a support bracket, such as the second clamping member 60 of the support bracket 100, according to an embodiment of the present invention. FIG. 5(*b*) is a rear surface view of a portion of a support bracket, such as the second clamping member 60 of the support bracket 100, according to an embodiment of the present invention. FIG. 5(*c*) is a top surface view of a portion of a support bracket, such as the second clamping member 60 of the support bracket 100, viewed from a direction of arrow Vc in FIG. 5(*a*) according to an embodiment of the present invention. FIG. 5(*d*) is a bottom surface view of a portion of a support bracket, such as the second clamping member 60 of the support bracket 100, viewed from a direction of arrow Vd in FIG. 5(*a*) according to an embodiment of the present invention.

The second clamping member 60 may include a ring portion 64 extending from the tubular body 61 in a first axial direction of the tubular body 61. The ring portion 64 may be shaped to have an outer diameter that is slightly less than an inside diameter of the opening 21 a of the main body 20 (e.g., FIG. 3(*a*)) to allow the ring portion 64 to fit within the opening 21*a* of the main body 20. The second clamping member 60 may include a plurality of ribs 65 extending from the tubular body 61 in a second axial direction of the tubular body 61, opposite the first axial direction.

The second clamping member 60 may include a first insertion hole 61*a* and a second insertion hole 61*b*. The first insertion hole 61*a* and the second insertion hole 61*b* may each pass through the tubular body 61 and be located opposite each other. As such, the second support rod 3 (e.g., FIG. 2) may be inserted through the first insertion hole 61*a* and the second insertion hole 61*b* to pass through the tubular body 61. The second passage 23 may extend through the first insertion hole 61*a* and the second insertion hole 61*b* in a case where the second clamping member 60 is fit in the main body 20 (refer to FIG. 7(*b*)).

The tubular body 61 may include a moveable surface 61*c* encircled by a first slit 61*c*1, a second slit 61*c*2, and a third slit

61c3. The first slit 61c1 may extend along a portion of a circumference of the tubular body 61 near the first limiting member 62. Thus, the moveable surface 61c may be separated from the first limiting member 62 by the first slit 61c1. The second slit 61c2 may be parallel to the first slit 61c1 and extend between the tubular body 61 and the second limiting member 63. That is, the second list 61c2 may extend along a portion of a circumference of the tubular body 61 near the second limiting member 63. Thus, the moveable surface 61c may be separated from the second limiting member 63 by the second slit 61c2. The third slit 61c3 may extend along the axial direction of the tubular body 61 through the first insertion hole 61a to an end of each of the first slit 61c1 and the second slit 61c2

Figure 5B:
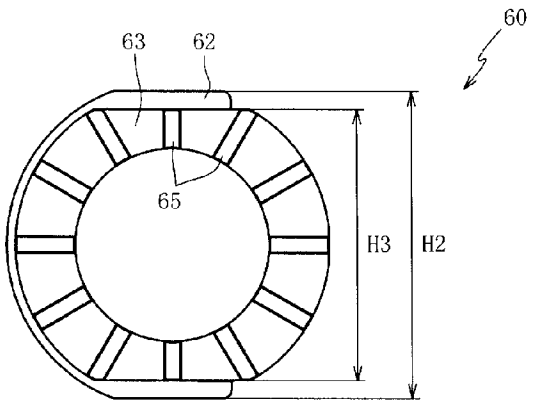
FIG. 5(*a*) is a view of a portion of a support bracket according to an embodiment of the present invention.
Figure 5A:
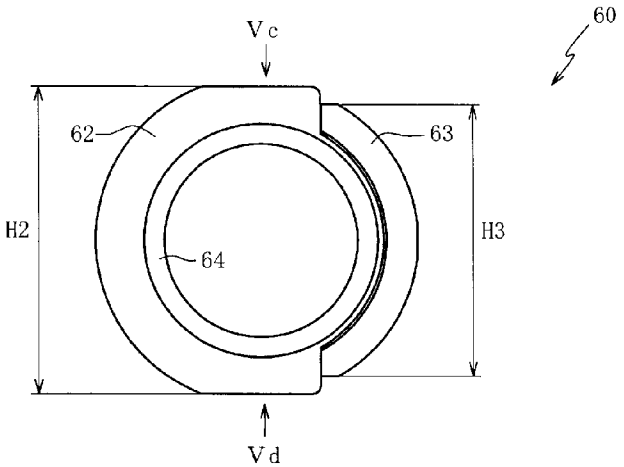
Figure 5D:
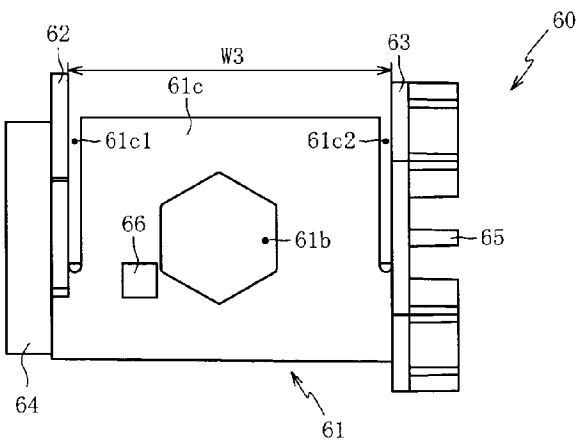
Figure 5C:
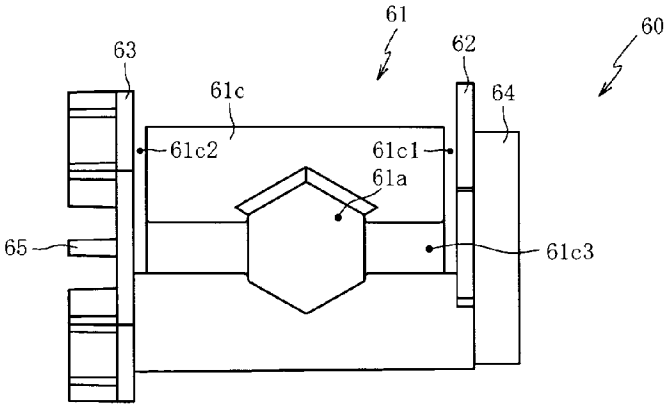

A height of the first limiting member 62, for example between the mutually parallel linear surfaces of the first limiting member 62 (e.g., top to bottom direction in FIG. 5(a)), may be defined as height H2. A height of the second limiting member 63, for example between the mutually parallel linear surfaces of the second limiting member 63 (e.g., top to bottom direction in FIG. 5(b)), may be defined as height H3. The height H2 may be greater than the height H1 (e.g., FIG. 4(b)), and thus the height H3 may be less than the height H1.

A length dimension (in an axial direction) of the tubular body 61 may be defined as width W3. Width W3 may be less than the width W2 (e.g., FIG. 4(b)), and greater than the width W1 (e.g., FIG. 4(b)). Thus, the width W2 may be greater than the width W3, which may be greater than the width W1.

With reference to FIGS. 4(a)-5(d), therefore, by inserting the second limiting member 63 of the second clamping member 60 between the pair of guiding portions 54 of the first clamping member 50, the pressing portion 51 of the first clamping member 50 may be fit between the first limiting member 62 and the second limiting member 63 of the second clamping member 60. As such, the first clamping member 60 can be fit to the second clamping member 60. Accordingly, movement of the first clamping member 50 in the axial direction may be limited by the first limiting member 62 and the second limiting member 63.

In various embodiments, the first clamping member 50 and/or the second clamping member 60 may be configured such that the first clamping member 50 and the second clamping member 60 may be fit together in a preconfigured manner (e.g., to fit together in only one manner), yet prevent the first clamping member 50 and the second clamping member 60 from being fit in any manner different from the preconfigured manner.

In some embodiments, the second clamping member 60 may include a protrusion on the outer peripheral surface of the tubular body 61 opposite the moveable surface 61c of the tubular body 61. In particular embodiments, dimensions between the protrusion 66 and the first limiting member 62 (and/or any portion of the support bracket 100) may be selected to allow the first clamping member 50 and the second clamping member 60 to be fit together in a preconfigured manner (e.g., to fit together in only one manner), yet prevent the first clamping member 50 and the second clamping member 60 from being fit in any manner different from the preconfigured manner. For instance, the protrusion and/or the first limiting member 62 may be configured such that the first clamping member 50 and the second clamping member 60 can be fit together in only one manner. For example, the protrusion 66 may allow the protruding section 52a of the first clamping member 50 to fit with the first limiting member 62 of the second clamping member 60, but not allow the protruding section 52b of the first clamping member 50 to fit with the first limiting member 62 of the second clamping member 60, for example, because the guiding portion 54 of the protruding section 52b is blocked by the protrusion 66.

Alternatively, or in addition, the protrusion 66 may allow the protruding section 52b of the first clamping member 50 to fit with the second limiting member 63 of the second clamping member 60 in a first manner (e.g., bringing the first clamping member 50 and the second clamping member 60 toward each other in FIG. 2), but not allow the protruding section 52b of the first clamping member 50 to fit with the second limiting member 63 of the second clamping member 60 in another manner, for example, in a case where the second clamping member is fit with the first clamping member upside-down (in the orientation of FIG. 2).

In such embodiments, the first clamping member 50 and the second clamping member 60 may be fit together only in a case where the second limiting member 63 is inserted between the pair of guiding portions 54 so that the first pressing surface 51a faces the moveable surface 61c. Thus in various embodiments, the first clamping member 50 and/or the second clamping member 60 may be configured to prevent the components from being combined incorrectly. As a result, the second passage 23 may extend through the first insertion hole 61a and the second insertion hole 61b in a case where the second clamping member 60 is inserted into the main body 20.

Figure 7A:
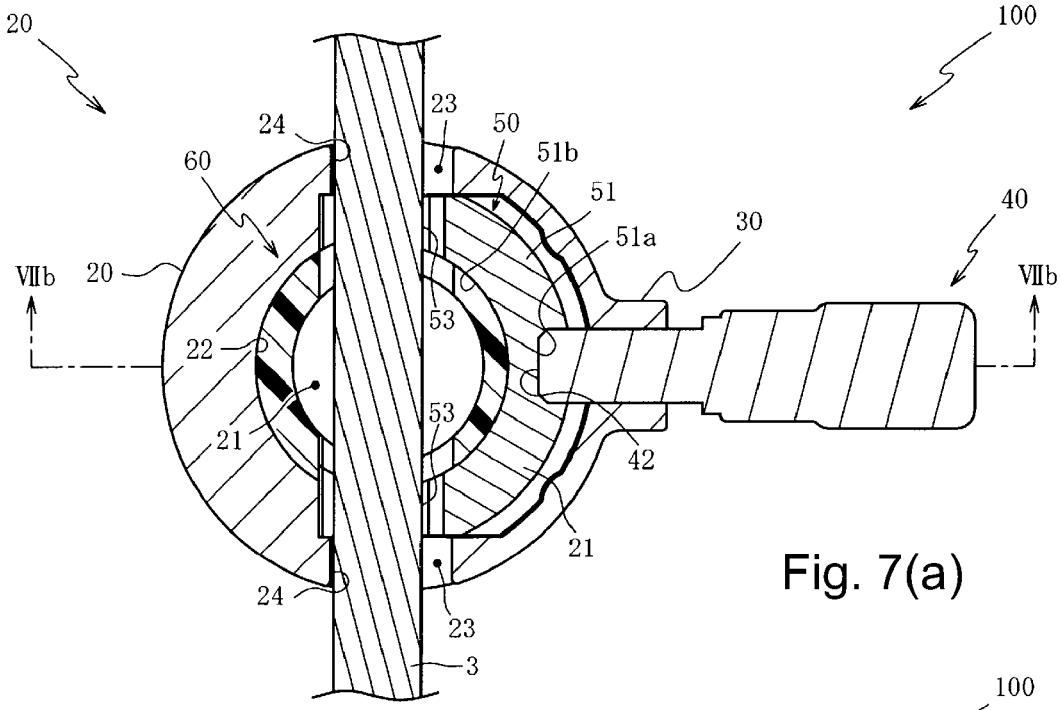
FIG. 7(*a*) is a cross-section view of a support bracket along line VIIa-VIIa of FIG. 1(*b*) according to an embodiment of the present invention.
Figure 7B:
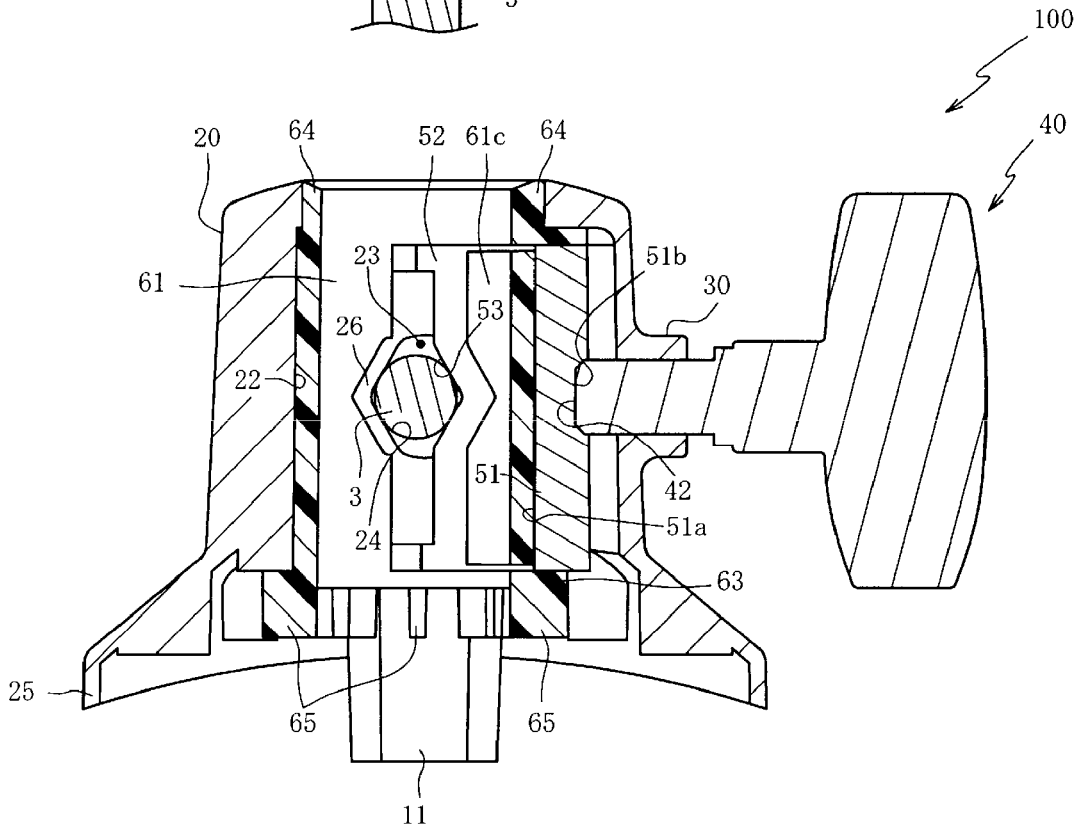

The first clamping member 50 may be configured such that in a case where the first clamping member 50 is fit with the second clamping member 60, the second pressing surface 53 of the first clamping member 50 is arranged over the first insertion hole 61a of the second clamping member 60 so that a portion of the first insertion hole 61a is blocked by the engagement portion 52 of the first clamping member 50 (refer to FIG. 7(b)).

The first clamping member 50 and the second clamped member 60, which are fit together, may be inserted into the main body 20 through a rear surface of the main body 20 (e.g., right side of the main body 20 in FIG. 2) so that the striking section 51b of the first clamping member 50 may face the channel 30, and the ring portion 64 of the second clamping member 60 is fit into the opening 21a of the main body 20. Accordingly, the first support rod 2 may be inserted into the opening 21 a and the ring portion 64 into a hollow interior of the second clamping member 60.

In some embodiments, movement (e.g., rotation) of the second clamping member 63 may be limited within the main body 20. For instance, the coupling surface 27 may prevent movement of the first limiting member 62 within the main body 20. In addition, because the second clamping member 60 (e.g., the first limiting member 62) is fit in the main body 20, falling out of the second clamping member 60 from the main body 20 may be substantially prevented.

Figure 6A:
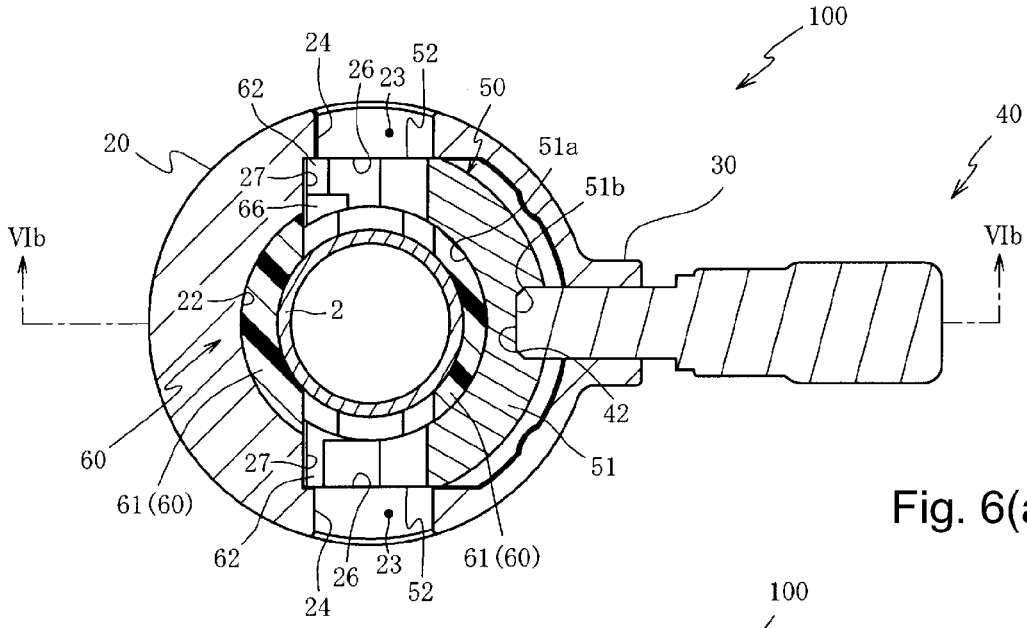
FIG. 6(*a*) is a cross-section view of a support bracket along line VIa-VIa of FIG. 1(*a*) according to an embodiment of the present invention.
Figure 6B:
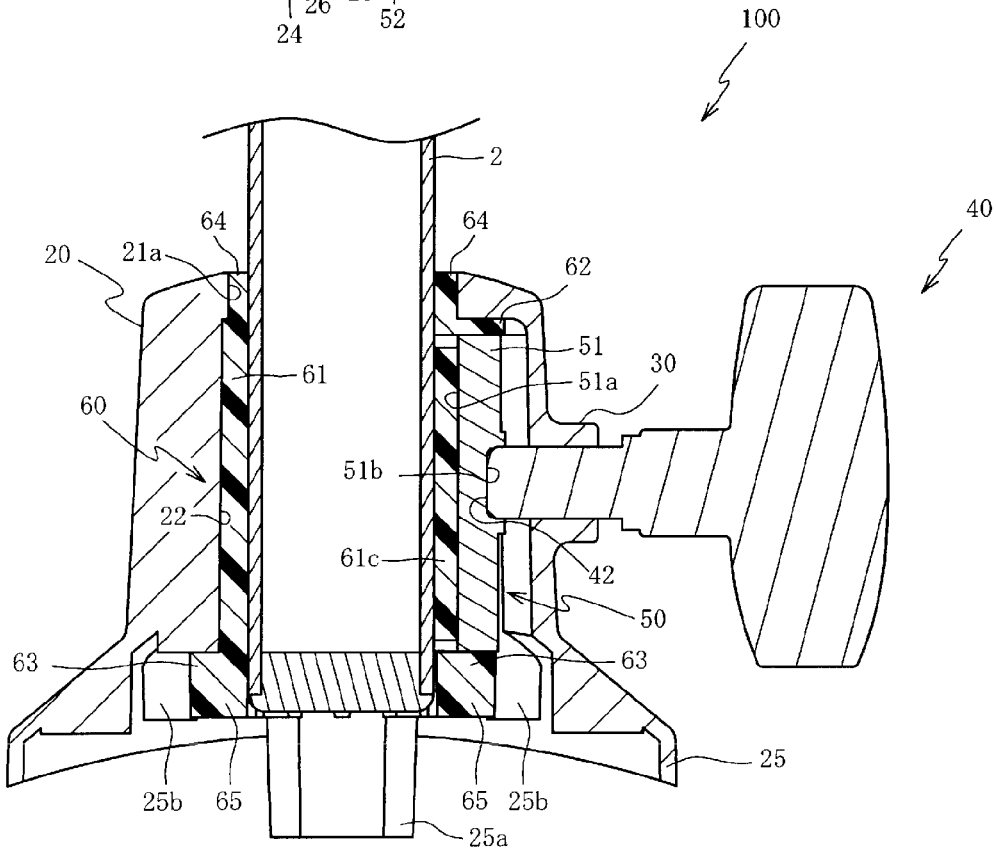

In various embodiments, for example as shown in FIG. 6(b), the ribs 65 of the second clamping member 60 may extend roughly as far as the holes 25b in a case where the first clamping member 50 and the second clamping member 60 are fit in the main body 20. Thus, movement of the second clamping member 60 in the axial direction (e.g., top to bottom in FIG. 6(b)) may be limited in a case where the first clamping member 50 and the second clamping member 60 are fit into the main body 20 and the metal plate is attached to the rear surface of the main body 20.

FIGS. 6(a) and 6(b) illustrate a support bracket, such as the support bracket 100, in which a support rod, such as the first support rod 2, is clamped. FIG. 6(a) is a cross-section view of a support bracket, such as the support bracket 100, along line VIa-VIa of FIG. 1(a) according to an embodiment of the present invention. FIG. 6(b) is a cross-section view of a support bracket, such as the support bracket 100, along line VIb-VIb of FIG. 6(*a*) according to an embodiment of the present invention.

With reference to FIGS. 1(*a*)-6(*b*), the first support rod 2 may be placed in the support bracket 100. The fastening member 40 may be fastened (e.g., screwed) in the channel 30 to secure the first support rod 2 in the first passage 21 to fix the first support rod 2 to the support bracket 100.

As the fastening member 40 is fastened within the channel 30, the end surface 42 of the fastening member 40 presses upon the striking section 51*b* of the first clamping member 50. As such, the striking section 51*b* is pressed in a direction in which the fastening member 40 is fastened into the channel 30. Furthermore, because force provided by the fastening member 40 is applied to the pressing portion 51, force may be distributed over a large area of the first support rod 2.

In some embodiments, the striking section 51*b* may be formed to have a similar shape as the end surface 42 of the fastening member 40. Such embodiments may allow the force provided by the fastening member 40 to be transmitted more efficiently to the pressing portion 51. For example, the end surface 42 of the fastening member 40 may be formed to have a planar shape, and the striking section 51*b* may be formed to have a planar shape to receive the end surface 42 of the fastening member 40. In other embodiments, the striking section 51*b* and the end surface 42 of the fastening member 40 may be formed to have differing shapes from each other.

As the end surface 42 presses on the pressing portion 51 of the first clamping member 50, the engagement portion 52 of the first clamping member 50 slides or otherwise moves along the sliding surfaces 26 of the main body 20. That is, the first clamping member 50 is guided or otherwise moved in the direction in which the fastening member 40 is fastened to the main body 20 so that the first pressing surface 51*a* is brought toward the first support rod 2. Thus, movement of the first limiting member 50 in any other direction may be limited As the pressing portion 51 is pressed by the end surface 42 of the fastening member 40, the tubular body 61 is pressed to the first wall surface 22 of the main body 20. In addition, the moveable surface 61*c* is pressed upon by the first pressing surface 51*a* to elastically deform or otherwise move the moveable surface 61*c* toward the interior of the second clamping member 60. Thus, in a case where the first support rod 2 is provided in the interior of the second clamping member 60 (e.g., in the first passage 21), a diameter of the interior may decrease as the moveable surface 61*c* is pressed upon by the first pressing surface 51*a* to clamp or otherwise fix the first support rod 2 in the main body 20. In particular embodiments, the first support rod 2 may be configured to prevent slippage or falling out of the main body 20. For example, the second clamping member 60 may be formed of a synthetic resin or the like, to reduce slippage or falling out of the main body 20.

Because the moveable surface 61*c* is separate from the first limiting member 62, the second limiting member 63, and the ring portion 64 by the first slit 61*c*1, the second slit 61*c*2, and the third slit 61*c*3, elastic deformation of the first limiting member 62, the second limiting member 63, and the ring portion 64 from the force of the pressing portion 51 may be reduced. Thus, even in a case where, the first support rod 2 is clamped or otherwise fixed to the support bracket 100 for a long period, warping or other deformation of the first limiting member 62, the second limiting member 63, and the ring portion 64 from the force of the pressing portion 51 may be avoided.

FIGS. 7(*a*) and 7(*b*) illustrate a support bracket, such as the support bracket 100, in which a support rod, such as the second support rod 3, is clamped. FIG. 7(*a*) is a cross-section view of a support bracket, such as the support bracket 100, along line VIIa-VIIa of FIG. 1(*b*) according to an embodiment of the present invention. FIG. 7(*b*) is a cross-section view of a support bracket, such as the support bracket 100, along line VIIb-VIIb of FIG. 7(*a*) according to an embodiment of the present invention.

With reference to FIGS. 1(*a*)-5(*d*), 7(*a*), and 7(*b*), in a case where the second support rod 3 is inserted into the second passage 23, the fastening member 40 may be fastened in the channel 30 to fix the second support rod 3 to the support bracket 100. As the fastening member 40 is fastened in the channel 30, the end surface 42 of the fastening member 40 may be inserted into the striking section 51*b* of the first clamping member 50 to press the pressing portion 51 toward the second clamping member 60.

The first clamping member 50 may be configured such that in a case where the first clamping member 50 is fit with the second clamping member 60, the second pressing surface 53 of the first clamping member 50 is arranged over the first insertion hole 61*a* of the second clamping member 60 so that a portion of the first insertion hole 61*a* is blocked by the engagement portion 52 of the first clamping member 50 (refer to FIG. 7(*b*)). Because of this, the second pressing surface 53 may contact the second support rod 3 to press the second support rod 3 against the second wall surface 24 as the pressing portion 51 is pressed by the end surface 42 of the fastening member 40. Accordingly, the second support rod 3 may be clamped and fixed to the main body 20.

The second pressing surface 53 may allow for clamping the second support rod 3, which may have a diameter less than a diameter of the first support rod 2 (e.g., FIGS. 6(*a*) and 6(*b*)). Furthermore, the second wall surface 24 and/or the pair of second pressing surfaces 53 may be configured to limit movement (e.g., rotation) of the second support rod 3. For instance, as discussed, the second wall surface 24 and the pair of second pressing surfaces 52 may be formed in a wedge shape to prevent rotation of the second support rod 3.

With reference to FIGS. 1(*a*)-7(*b*), in various embodiments, clamping and fixing of different sized support rods may be performed by adjusting an amount with which the fastening member 40 is fastened. In other words, changing between a first support rod and a second support rod having a thickness less than the first support rod, requires nothing more than adjusting the amount with which the fastening member 40 is fastened. Thus, support rods of different thicknesses may be interchanged easily and quickly.

In various embodiments, the first support rod 2 may be inserted into the support bracket 100 in a direction perpendicular (i.e., at a right angle) to the axial direction of the drum 1 and the second support rod 3 may be inserted into the support bracket 100 in a direction parallel to the axial direction of the drum 1. In other embodiments, the support bracket 100 may be configured such that the second support rod 3 may be inserted into the support bracket 100 in a direction perpendicular (i.e., at a right angle) to the axial direction of the drum 1 and the first support rod 2 may be inserted into the support bracket 100 in a direction parallel to the axial direction of the drum 1. In yet other embodiments, the support bracket 100 may be configured such that the first support rod 2 and the second support 3 may be inserted into the support bracket 100 in any suitable direction.

In various embodiments, the support bracket 100 may include the first clamping member 50 and the second clamping member 60 which may be fit together and inserted into the main body 20 of the support bracket 100. In other embodiments, one or both of the first clamping member 50 and the second clamping member 60 may be omitted. For instance, in embodiments in which the first clamping member 50 and the second clamping member 60 are omitted, the first support rod 2 may be placed in the first passage 21 so that the end surface 42 of the fastening member 40 may press the first support rod 2 against the first wall surface 22 to clamp and fix the first support rod 2 to the main body 20. The second support rod 3 may be placed in the second passage 23 so that the end surface 42 of the fastening member 40 may press the second support rod 3 against the second wall surface 24 to clamp and fix the second support rod 3 to the main body 20.

For instance, in embodiments in which the second clamping member 60 is omitted, the first support rod 2 may be placed in the first passage 21 so that the first pressing surface 51*a* of the first clamping member 50 may press the first support rod 2 against the first wall surface 22 to clamp and fix the first support rod 2 to the main body 20. The second support rod 3 may be placed in the second passage 23 so that the second pressing surface 53 of the first clamping member 50 may press the second support rod 3 against the second wall surface 24 to clamp and fix the second support rod 3 to the main body 20.

For instance, in embodiments in which the first clamping member 50 is omitted, the first support rod 2 may be placed in the first passage 21 so that the end surface 42 of the fastening member 40 may press the moveable surface 61*c* of the second clamping member 60 to press the first support rod 2 against the first wall surface 22 to clamp and fix the first support rod 2 to the main body 20. The second support rod 3 may be placed in the second passage 23 (and through the first insertion hole 61*a* of the second clamping member 60) so that an inner wall surface of the first insertion hole 61*a* of the second clamping member 60 may press the second support rod 3 against the second wall surface 24 to clamp and fix the second support rod 3 to the main body 20.

In various embodiments, the first clamping member 50 may be made of metal. In other embodiments, the first clamping member 50 may be made of reinforced plastic or any other suitably rigid material.

In various embodiments, the cross-section of the first clamping member 50 may be formed to have a "U" shape. In other embodiments, the cross-section of the first clamping member 50 may be formed to have a "V" shape, a "C" shape, or any other suitable shape. In such embodiments, associated components, such as the main body 20 and/or the second clamping member 60 may be formed to have a complementary shape.

In various embodiments, the tubular body 61 may include the first slit 61*c*1, the second slit 61*c*2, and the third slit 61*c*3. In other embodiments, any or all of the first slit 61*c*1, the second slit 61*c*2, and the third slit 61*c*3 may be omitted from the tubular body 61.

The embodiments disclosed herein are to be considered in all respects as illustrative, and not restrictive of the invention. The present invention is in no way limited to the embodiments described above. Various modifications and changes may be made to the embodiments without departing from the spirit and scope of the invention. The scope of the invention is indicated by the attached claims, rather than the embodiments. Various modifications and changes that come within the meaning and range of equivalency of the claims are intended to be within the scope of the invention.

What is claimed is:

1. A bracket for mounting on a drum, the bracket comprising:

a main body section for mounting on the drum, the main body section having a screwing channel formed through a wall surface of the main body section, an inner peripheral surface defining the screwing channel, the inner peripheral surface having female threads;

a bolt member for screwing into the screwing channel of the main body section, the bolt member having male threads;

the main body section configured to clamp to one of a large diameter support rod for attaching to a drum fixing device and a small diameter support rod for attaching to a drum fixing device by screwing the bolt member into the screwing channel, the small diameter support rod having a diameter less than a diameter of the large diameter support rod;

the main body section having at least one first passage into which one of the large diameter support rod and the small diameter support rod is inserted, the first passage defined at least in part by a first wall surface, the first wall surface facing a direction in which the bolt member is screwed into the screwing channel;

the main body section having a second passage into which the other of the large diameter support rod and the small diameter support rod, relative to the one of the large diameter support rod and the small diameter support rod, is inserted, the second passage intersecting the first passage, the second passage defined at least in part by a same direction of the first wall surface;

wherein the one of the large diameter support rod and the small diameter support rod inserted into the first passage is clamped and fixed to the main body section by being pressed against the first wall surface by the bolt member; and wherein the other of the large diameter support rod and the small diameter support rod, relative to the one of the large diameter support rod and the small diameter support rod, inserted into the second passage is clamped and fixed to the main body section by being pressed against the second wall surface by the bolt member.

2. The bracket of claim 1, the bracket further comprising:

a first clamping member inserted between the first wall surface and the screwing channel, the first clamping member having a main surface having an area broader than an area of a tip surface of the bolt member;

wherein the one of the large diameter support rod and the small diameter support rod inserted in the first passage is fixed and clamped to the main body section by being pressed against the first wall surface by the main surface of the first clamping member; and wherein the other of the large diameter support rod and the small diameter support rod, relative to the one of the large diameter support rod and the small diameter support rod, inserted into the second passage is clamped and fixed to the main body section by being pressed against the second wall surface by the main surface of the first clamping member.

3. The drum of claim 2, the main body section having a pair of sliding surfaces facing each other and spaced apart a distance, the pair of sliding surfaces parallel to the direction in which the bolt member is screwed; and the first clamping member having a contact section in contact with the pair of sliding surfaces, the contact section configured to be guided by the pair of sliding surfaces in the direction in which the bolt member is screwed.

4. The bracket of claim 3, the bracket further comprising:

a cylindrical second clamping member made of a synthetic resin arranged in the main body section, the one of the large diameter support rod and the small diameter support rod fit into the second clamping member;

wherein the one of the large diameter support rod and the small diameter support rod fit into the second clamping member is clamped and fixed to the main body section by being pressed against a portion of the second clamping member elastically deformed by the bolt member.

5. The bracket of claim 1, the bracket further comprising:

a cylindrical clamping member made of a synthetic resin arranged in the main body section, the one of the large diameter support rod and the small diameter support rod fit into the clamping member;

wherein the one of the large diameter support rod and the small diameter support rod fit into the clamping member is clamped and fixed to the main body section by being pressed against a portion of the clamping member elastically deformed by the bolt member.

6. A support bracket for mounting on a percussion instrument, the support bracket comprising:

a body configured to be mountable on the percussion instrument, the body having a channel extending through a wall of the body, the body having a first passage defined at least in part by a first wall surface of the body, the first passage for receiving a first support rod, the body having a second passage defined at least in part by a second wall surface of the body, the second passage for receiving a second support rod; and a fastening member insertable into the channel of the body to operatively engage one of the first support rod and the second support rod;

wherein the fastening member is configured to clamp the first support rod to the body in a case where the first support rod is inserted into the first passage and the fastening member operatively engages the first support rod to press the first support rod against the first wall surface; and wherein the fastening member is configured to clamp the second support rod to the body in a case where the second support rod is inserted into the second passage and the fastening member operatively engages the second support rod to press the second support rod against the second wall surface.

7. The support bracket of claim 6, wherein the second support rod has a diameter less than a diameter of the first support rod.

8. The support bracket of claim 6, a surface defining the channel includes a threaded portion;

the fastening member having a threaded portion for engaging the threaded portion of the surface.

9. The support bracket of claim 6, at least one of the first support rod and the second support rod operatively connected to a stand for supporting the percussion instrument.

10. The support bracket of claim 6, wherein the first wall surface of the body faces a direction parallel to a direction in which the fastening member is inserted into the channel of the body.

11. The support bracket of claim 6, wherein the second wall surface of the body faces a direction parallel to a direction in which the fastening member is inserted into the channel of the body.

12. The support bracket of claim 6, wherein the first passage of the body intersects the second passage of the body.

13. The support bracket of claim 6, wherein the percussion instrument comprises a drum.

14. The support bracket of claim 6, the support bracket further comprising:

a first clamping member arranged in the body between the first wall surface of the body and the wall having the channel of the body;

wherein the first clamping member is configured to clamp the first support rod to the body in a case where the first support rod is inserted into the first passage and the fastening member causes the first clamping member to press the first support rod against the first wall surface; and wherein the first clamping member is configured to clamp the second support rod to the body in a case where the second support rod is inserted into the second passage and the fastening member causes the first clamping member to press the second support rod against the second wall surface.

15. The support bracket of claim 14, the first clamping member having an outer peripheral surface and an inner peripheral surface, the inner peripheral surface for contacting the one of the first support rod and the second support rod, the outer peripheral surface arranged to be pressed upon by the fastening member so that the inner peripheral surface contacts the one of the first support rod and the second support rod.

16. The support bracket of claim 14, the inner peripheral surface of the first clamping member having an area greater than an area of a portion of the fastening member pressing upon the outer peripheral surface.

17. The support bracket of claim 6, the support bracket further comprising:

a clamp member arranged in the body;

wherein the clamp member is configured to clamp the first support rod to the body in a case where the first support rod is inserted into the first passage and the fastening member causes the clamp member to press the first support rod against the first wall surface; and wherein the clamp member is configured to clamp the second support rod to the body in a case where the second support rod is inserted into the second passage and the fastening member causes the clamp member to press the second support rod against the second wall surface.

18. The support bracket of claim 17, the clamp member having a moveable portion;

wherein the clamp member is configured to clamp the first support rod to the body in a case where the first support rod is inserted into the first passage and the fastening member causes the moveable portion of the clamp member to press the first support rod against the first wall surface; and wherein the clamp member is configured to clamp the second support rod to the body in a case where the second support rod is inserted into the second passage and the fastening member causes the moveable portion of the clamp member to press the second support rod against the second wall surface.

* * * * *